US005898964A

United States Patent [19]

Stanley

[11] Patent Number: 5,898,964

[45] Date of Patent: May 4, 1999

[54] BUMPER PAD FOR BED RAIL

[76] Inventor: Faith Craft Stanley, 1850 Ashley Crossing La., Apt., 7A, Charleston, S.C. 29464

[21] Appl. No.: 09/092,724

[22] Filed: Jun. 5, 1998

[51] Int. Cl.[6] ..... A47C 21/08

[52] U.S. Cl. ..... 5/663; 5/425; 5/922

[58] Field of Search ..... 5/424, 425, 427, 5/663, 922, 946

[56] References Cited

U.S. PATENT DOCUMENTS

| | | | |
|---|---|---|---|
| D. 365,957 | 1/1996 | Ferrari | 5/946 X |
| 2,600,556 | 6/1952 | Malm | 5/93 |
| 3,619,824 | 11/1971 | Doyle | 5/93 |
| 3,742,530 | 7/1973 | Clark | 5/663 X |
| 4,215,446 | 8/1980 | Mahoney | 5/425 |
| 4,439,880 | 4/1984 | Koncelik et al. | 5/429 |
| 4,525,883 | 7/1985 | Becowitz | 5/93 |
| 4,827,545 | 5/1989 | Arp | 5/663 X |
| 4,890,346 | 1/1990 | Rist | 5/508 |
| 5,044,025 | 9/1991 | Hunsinger et al. | 5/425 X |
| 5,175,897 | 1/1993 | Marra, Jr. | 5/663 X |
| 5,241,718 | 9/1993 | Pope | 5/424 |
| 5,410,765 | 5/1995 | Dicken | 5/93.1 |
| 5,481,772 | 1/1996 | Glynn et al. | 5/663 |
| 5,542,135 | 8/1996 | Ozrovitz et al. | 5/424 |
| 5,557,817 | 9/1996 | Haddock | 5/663 |
| 5,706,534 | 1/1998 | Sherman | 5/424 |

*Primary Examiner*—Michael F. Trettel

*Attorney, Agent, or Firm*—Kathleen M. Harleston; Harleston Law Firm

[57] ABSTRACT

A one-piece, protective bumper pad adapted for removable placement on a rail of a bed or the like is described. The bumper pad comprises: a generally flat, elongated body of a soft, flexible material, the body being generally rectangular in shape and having a length dimension which is approximately equal to the length of the rail and a width dimension which is approximately equal to the width of the rail; the body being pocket-shaped and capable of fitting over and substantially covering the rail, and comprising two elongated sides; the body further comprising a closed edge and an opposite, open edge, and two opposite, closed end edges, the two closed end edges of the body being shorter in length than the other two edges of the body; the two elongated sides of the body comprising a soft, flexible, cushioning core along the interior; the two elongated sides further comprising an outside and an inside, the outside comprising lock and loop fastener; and a plurality of means for removable attachment of the elongated body to the rail.

10 Claims, 2 Drawing Sheets

BUMPER PAD FOR BED RAIL

CROSS REFERENCE TO RELATED APPLICATIONS

Not Applicable

STATEMENT REGARDING FEDERALLY SPONSORED RESEARCH OR DEVELOPMENT

Not Applicable

REFERENCE TO A MICROFICHE APPENDIX

Not Applicable

BACKGROUND OF THE INVENTION

1. Technical Field

This invention relates to a one-piece bumper pad which fits bed rails of various lengths, more particularly a removable, washable, comfortable, easily installed bumper pad for covering a rail on a geriatric or hospital bed.

2. Background Information

With the post-war "Baby Boomers" approaching retirement age, the already high numbers of people over age 60 are expected to swell. While many retirees remain healthy, a certain percent unfortunately become infirm or encounter physical ailments which will cause them to become bedridden. With the high number of elderly people who are or will be spending various periods of time in hospitals, long term care facilities, nursing homes, retirement homes, and home care, additional special hospital/geriatric beds are or will soon be needed. Those beds, which are currently used in hospitals by patients of all ages, usually have bed rails for helping to prevent patients from falling or getting out of bed. Sometimes the hands of patients who are delirious or who have diminished mental capacity are tied with padded wrist bands to bed rails to prevent them from leaving the bed or pulling out their intravenous transfusion lines (IVs). For those patients who are confined to a bed in a sterile room for most of the day, small comforts are much appreciated.

The present invention is a removable, washable, one-piece bumper pad for cushioning patients of any age, but particularly bedridden geriatric patients, from the rails on these beds. Bed rails usually comprise metal bars. They are cold and hostile looking, particularly when viewed up close from a prone position. The bumper pads of the present invention are soft and padded to cushion the limbs of the patient in the bed against contact with the bed rails. Covering the bed rails should also reduce minor injuries which result from bumping or scaping the hands, arms or legs against the bed rails and possibly pulling out an IV or other tubes attached to the patient. This is particularly important for the delirious patient who is tied to and may be thrashing against the bed and rails. The present bumper pads also serve to protect the bed rails to some extent from the patients and visitors.

Bed rails can be short or long in length. Most hospital/geriatric beds have two short rails on opposite sides of the bed. These are between about 35 and 40 inches long and about 18 to 22 inches in height. When a person is lying in the bed, the rails are approximately at chest level. Some beds have four sets of short rails, two each on opposite sides of the bed. The set of rails at the lower end of the bed are to help discourage the patient from swinging his legs over the edge of the bed to get up. This helps to prevent falls. Some beds have two short rails on opposite sides of the bed which telescope into longer rails of between about 75 and 80 inches in length. These rails can be used in the short position or be pulled out into a longer position once the patient is in the bed. The present bumper pad can also fit a telescoping bed rail. The bumper pad of the present invention can be "closed" to cover short bed rails or it can be "opened" to fit longer bed rails. The present bumper pad can fit one short rail, or two short rails which are positioned end to end along one side of a bed, or various rail lengths in between.

BRIEF SUMMARY OF THE INVENTION

The present invention is a one-piece, protective bumper pad adapted for removable placement on a rail of a bed or the like is described. The bumper pad comprises: a generally flat, elongated body of a soft, flexible material, the body being generally rectangular in shape and having a length dimension which is approximately equal to the length of the rail and a width dimension which is approximately equal to the width of the rail; the body being pocket-shaped and capable of fitting over and substantially covering the rail, and comprising two elongated sides; the body further comprising a closed edge and an opposite, open edge, and two opposite, closed end edges, the two closed end edges of the body being shorter in length than the other two edges of the body; the two elongated sides of the body comprising a soft, flexible, cushioning core along the interior; the two elongated sides further comprising an outside and an inside, the outside comprising lock and loop means; and a plurality of means for removable attachment of the elongated body to the rail.

BRIEF DESCRIPTION OF THE SEVERAL VIEWS OF THE DRAWINGS

A more complete understanding of the invention and its advantages will be apparent from the following detailed description taken in conjunction with the accompanying drawings, wherein examples of the invention are shown, and wherein.

DETAILED DESCRIPTION OF THE INVENTION

Figure 1:
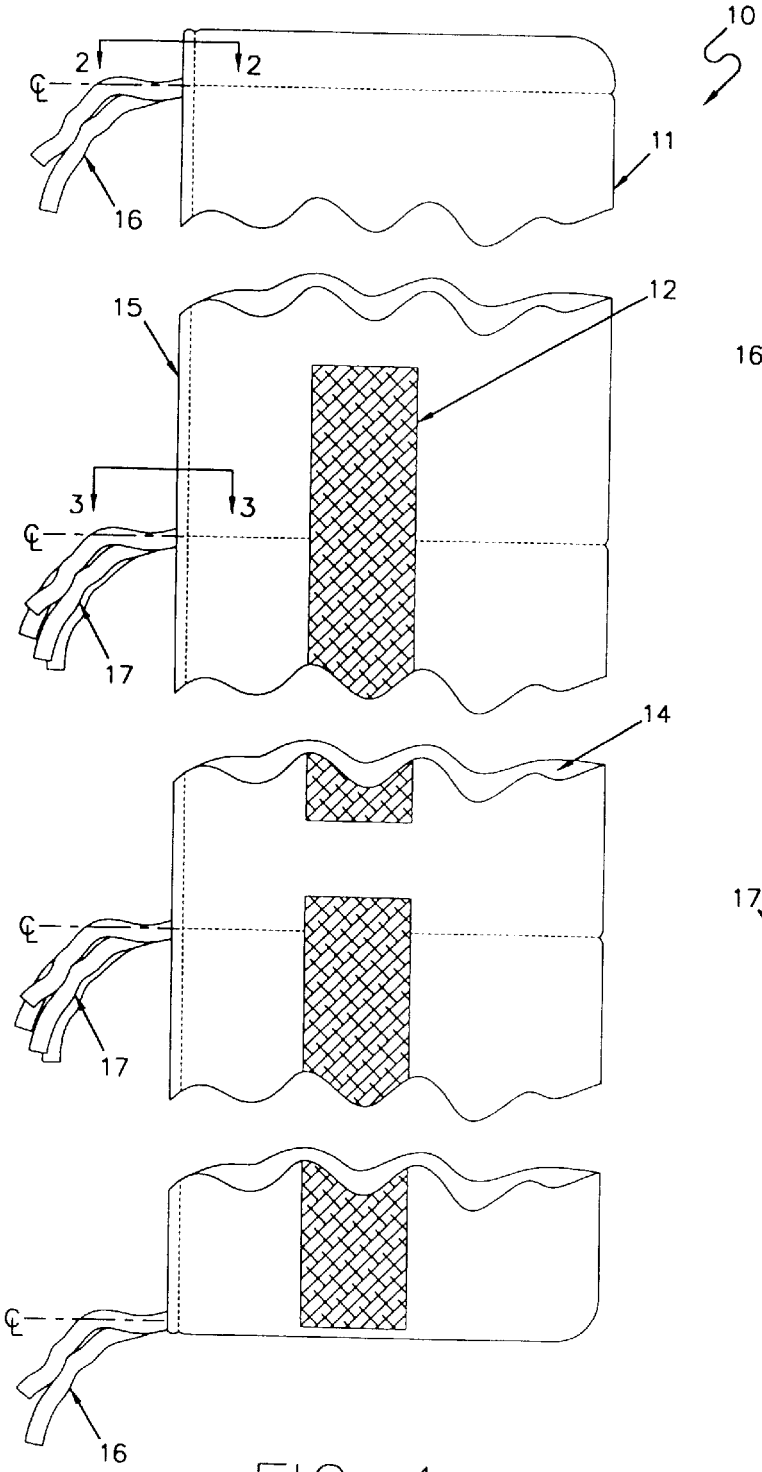
FIG. 1 shows a plan view of a bumper pad according to the present invention.

In the following description, like reference characters designate like or corresponding parts throughout the several views. Also, in the following description, it is to be understood that such terms as "front," "back," "within," and the like are words of convenience and are not to be construed as limiting terms. Referring in more detail to the drawings, the invention will now be described.

Referring to FIG. 1, a bumper pad 10 for a bed rail is shown from the outside 11 of the pad, which is the side that faces away from the bed when the pad is installed on the rail. In FIG. 1, the bumper pad 10 is shown unfolded and uninstalled, with laces to the left of the figure. This side 11 of the bumper pad 10 comprises at least one, preferably two, lock and loop 12 strips which have been attached to the bumper pad 10 lengthwise in approximately the center of the outside 11 of the pad 10. The opposite side of the bumper pad, which is the inside 13, faces toward the bed when the pad 10 is installed. The inside 13 does not have the central strips of lock and loop 12, but is otherwise similar in appearance to the outside 11 of the bumper pad 10. FIG. 1 is shown with cuts along the pad for purposes of illustration because the pad is so long.

Most hospital or geriatric beds have two single bed rails, one on each side of the bed. The rails are usually attached to a bed along opposite sides of the upper portion of the bed. Some rails are detachable from the bed and others can be lowered and pushed into a storage position beneath the bed. Ordinarily, a set of the present bumper pads would be purchased and one bumper pad 10 would be placed on each of the two rails on a bed, preferably a hospital or geriatric bed. It would alternatively be feasible to place a single bumper pad 10 on a single bed rail.

These pads are preferably made of a colorful, washable fabric, preferably approximately 150 to 300 thread cotton percale, to brighten up the patient's room and make it more home-like in appearance. These bumper pads 10 are easy to slide onto and off of bed rails (which are sometimes called side rails or guard rails) and are preferably removed from the rail periodically and washed and dried in a standard washing machine and dryer.

The pads can be made by machine sewing the appropriate lengths of fabric together. One bumper pad has two sides which are the same except that only one side has the lock and loop strips sewn on. Each side is made from a strip of fabric which is approximately 80 inches long and 20 inches wide. For strength and comfort, the seam affixing one side of the pad to the other runs along the top edge (which is to the right of FIG. 1) of the bumper pad.

Cotton and/or polyester batting, padding, or other cushioning 14 is placed between the fabric layers 11, 13 in the interior of the bumper pad 10 to make the pad soft to the touch. Preferably, an approximately 78 inch length of ½ inch washable polyester batting is inserted between the two sides of the piece of cloth after the cloth has been folded in half lengthwise, but before the edges of the fabric have been sewn together to form the pad. The sides of the pad are preferably machine stitched across their width at several locations along the bumper pad. This is to prevent the fabric in the front and back of each side from separating and to prevent the batting in the interior of the pad from bunching. The edges of the bumper pad are preferably finished with seam binding or piping 15 so that the edges of the fabric will not unravel during repeated washing.

Figure 4:
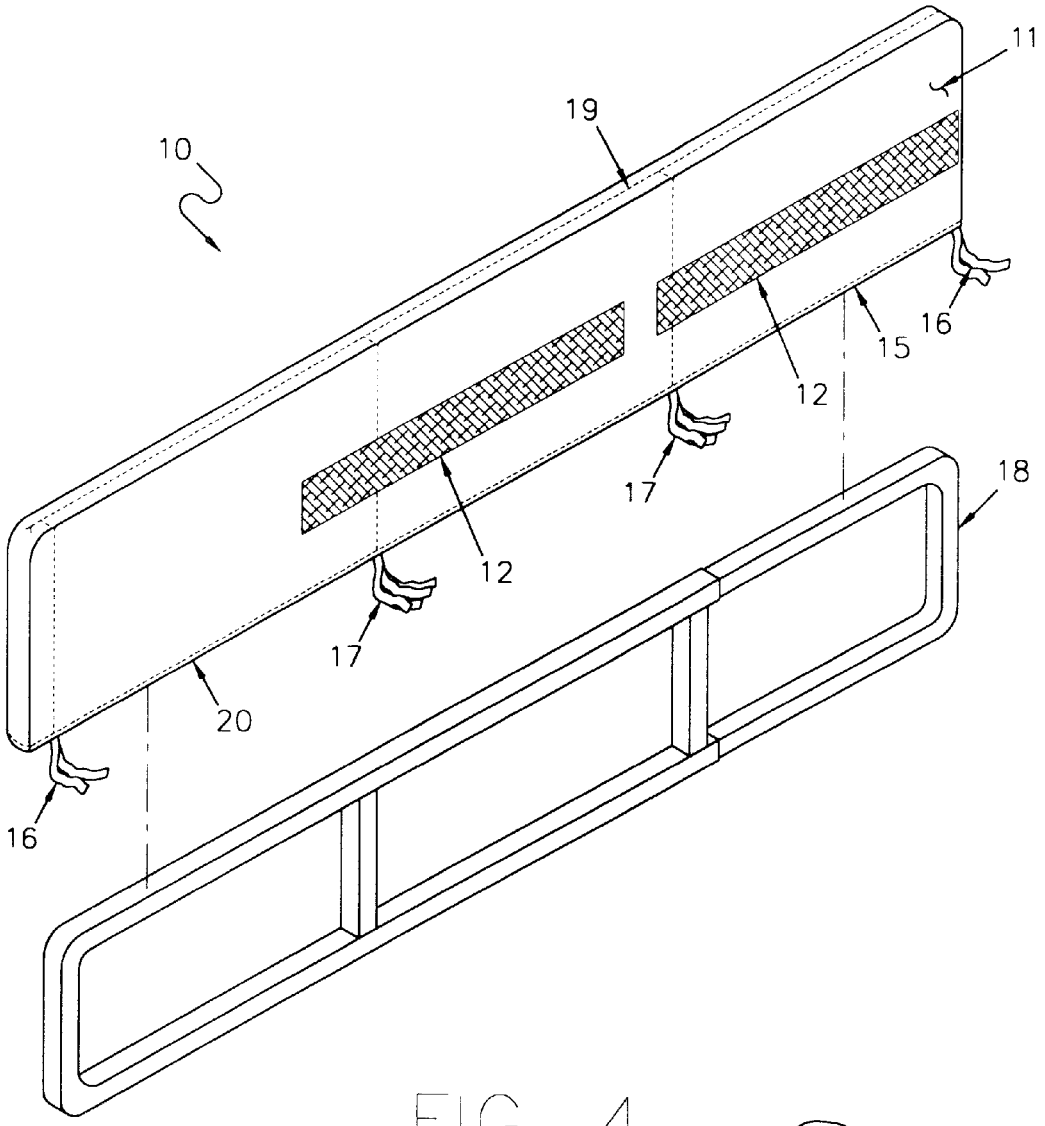
FIG. 4 shows a perspective view of a bumper pad according to the present invention and a bed rail.

Along the approximate center of the outside of the pad, two strips of lock and loop fastener 12 are sewn lengthwise, end to end with a space between, onto the fabric as shown in FIGS. 1 and 4. Each strip is approximately 26 inches long and 2 inches wide. The ends of the two strips are about 4½ inches apart. The strip which begins at the end of the bumper pad 10 is the "lock" strip, and the adjacent strip is the "loop" strip. When the bumper pad is folded, the "lock" strip attaches to the "loop" strip.

The pad 10 should fit snugly over the bed rail, yet be loose enough for a user to easily slide the pad onto and off of the rail. The pocket-like pad slips easily over the rail without the need for extra labor to accomplish diaper-like folding of the sides or the attachment of one side of the pad to the other via multiple straps or the like. The present bumper pad preferably has dimensions which are only slightly longer and wider than the dimensions of the rail which it is designed to cover. The preferred embodiment of the bumper pad of the present invention is approximately 78 inches in length and 9½ inches wide.

The present bumper pad 10 can be used for a "split rail," which is just two shorter rails placed end to end along the side of the bed. The pad would cover both rails, as well as the space between them.

The laces are preferably made of the same material as the remainder of the pad and are sewn into the seams with reinforced stitching for strength. Each set of laces is preferably one 16 inch fabric tie which has been folded in half and sewn into the binding at the edge of the pad. The sets of laces are spaced relatively evenly along the bumper pad and help to prevent the pad from being pulled up and off the rail.

Figure 2:
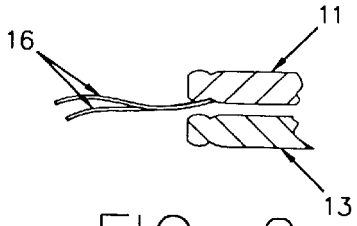
FIG. 2 is a cross-sectional view of the end lace area taken along the lines 2—2 in FIG. 1.

Referring to FIGS. 1 and 2, there are laces at four locations along the bumper when the bumper is viewed from one side. First, at each end of the bumper pad 10 is a single set of laces which are called end laces 16 here.

Figure 3:
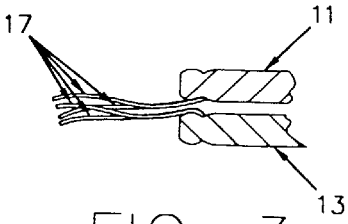
FIG. 3 is a cross-sectional view of a middle lace area taken along the lines 3—3 in FIG. 1.

Referring to FIGS 1 and 3, there are also two sets of laces at a point which is approximately one third along the length of the bumper 10, and another two sets of laces at a point which is approximately two thirds of the way along the bumper pad. These are the middle laces 17. Each of these two sets of laces is sewn into the seam binding 15 at the edge of opposite sides of the pad, so that the two sets of laces are opposite each other. Thus, two sets of middle laces 17 are on the inside 13 of the bumper pad and two are on the outside 11 of the bumper pad.

Referring to FIG. 4, a fully extended bumper pad 10 is shown just prior to application over a long rail, or an extended telescoping bed rail 18. To put the bumper pad 10 on the rail, the pad is preferably held outstretched between the two hands of the worker with the outside 11 facing the worker and the laces hanging down. The worker then slides the bumper pad 10 over each end of the bed rail 18.

Once the pad 10 is on the rail, the laces 16, 17 should be tied onto the lower rail of the bed rail 18. The laces should not be knotted onto the rail as the pad would then be difficult to remove from the rail for washing. Any flexible material for strapping the pad onto the rail is suitable for the laces, although fabric laces are preferred.

Figure 5:
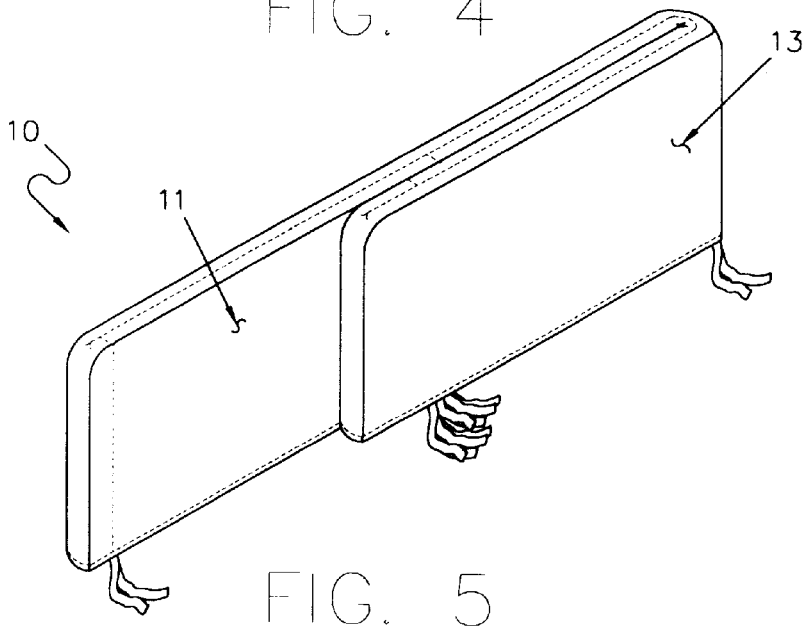
FIG. 5 is a perspective view from the top edge of the bumper pad according to FIG. 4, showing the bumper pad in a folded position.

Referring to FIG. 5, the length of the bumper pad 10 can be decreased by folding to the outside (away from the bed) whatever part of the pad is left loose on the end of the rail 18. This can be done before or after the pad is installed on the rail. The pad 10 folds along center lines as indicated in FIG. 1 into the folded position shown in FIG. 5. The edge of the pad shown in FIG. 5 is the top edge, which is the edge with a seam along it. Opposite the seamed edge are the edges with the laces 16, 17, which are not visible in the FIG. 5 perspective. The pad 10 can also be stored in the folded position when it is not in use so that the lock and loop 12 is kept clean. In the folded position, the "lock" strip is pressed along the "loop" strip, which keeps the pad from unfolding. The lock and loop strips 12 are on the outside 11 of the bumper pad 10. The other side of the bumper pad is the inside 13. The pad 10 can easily be unfolded, though, by pulling the lock and loop strips 12 apart for removal or use on a longer rail, for example.

The present bumper pad could be used for any telescoping side or head rail where comfort or protection is desired. The present bumper pads can be made for and installed on, for example, crib or playpen rails or small rails on a toddler bed. The design of the laces could be modified with an infant's or toddler's safety in mind if the present bumper pad is to be used near babies or small children.

In summary, this is a one-piece, protective bumper pad 10 adapted for removable placement on a rail of a bed 18 or the like, the bumper pad 10 comprising:

a generally flat, elongated body of a soft, flexible material, the body being generally rectangular in shape and having a length dimension which is approximately equal to the length of the rail and a width dimension which is approximately equal to the width of the rail;

the body being pocket-shaped and capable of fitting over and substantially covering the rail, and comprising two elongated sides 11, 13;

the body further comprising a closed edge 19 and an opposite, open edge 20, and two opposite, closed end edges 21, the two closed end edges 21 of the body being shorter in length than the other two edges of the body 19, 20;

the two elongated sides of the body comprising a soft, flexible, cushioning core along the interior 14;

the two elongated sides further comprising an outside 11 and an inside 13, the outside comprising lock and loop fastener 12; and a plurality of means 16, 17 for removable attachment of the elongated body to the rail; and wherein when the body is bent in two along its width, the lock and loop fastener 12 can be secured to each other; the bumper pad being capable of placement on the rail 18 in an extended or folded position.

Preferably, each elongated side is comprised of cotton or polyester fabric. Each elongated side is between about 70 and about 160 inches in length and between about 10 and about 30 inches in width. The two sides are preferably sewn together along one long edge and along the two end edges. When folded, the bumper pad is preferably between about 70 and about 100 inches in length.

While preferred embodiments of the invention have been described using specific terms, this description is for illustrative purposes only. It will be apparent to those of ordinary skill in the art that various modifications may be made without departing from the spirit or scope of the invention, and that such modifications are intended to be within the scope of the present invention.

What is claimed is:

1. A one-piece, protective bumper pad adapted for removable placement on a rail of a bed or the like, the bumper pad comprising:

a generally flat, elongated body of a soft, flexible material, the body being generally rectangular in shape and having a length dimension which is approximately equal to the length of the rail and a width dimension which is approximately equal to the width of the rail;

the body being pocket-shaped and capable of fitting over and substantially covering the rail, and comprising two elongated sides;

the body further comprising a closed edge and an opposite, open edge, and two opposite, closed end edges, the two closed end edges of the body being shorter in length than the other two edges of the body;

the two elongated sides of the body comprising a soft, flexible, cushioning core along the interior;

the two elongated sides further comprising all outside and an inside, the outside comprising lock and loop fastener; and a plurality of means for removable attachment of the elongated body to the rail; and wherein when the body is bent in two along its width, the lock and loop fasteners can be secured to each other; the bumper pad being capable of placement on the rail in an extended or folded position.

2. A bumper pad according to claim 1, wherein the plurality of means for removable attachment to the rail are flexible, elongated laces or ties, each connected in spaced relation along the edges of the open side of the elongated body.

3. A bumper pad according to claim 2, wherein there are two strips of lock and loop fastener on the outside side of the bumper pad.

4. A bumper pad according to claim 3, comprised of cotton or polyester fabric.

5. A bumper pad according to claim 4, wherein each elongated side is between about 70 and about 160 inches in length and between about 10 and about 30 inches in width when the bumper pad is in the extended position.

6. A bumper pad according to claim 5, with a length of between about 70 and about 100 inches when the bumper pad is in the extended position.

7. A device for providing protection and comfort to a bedridden person, the device comprising, in combination:

(a) a one-piece, protective bumper pad adapted for removable placement on a rail of a bed or the like, the bumper pad comprising:

a generally flat, elongated body of a soft, flexible material, the body being generally rectangular in shape and having a length dimension which is approximately equal to the length of the rail and a width dimension which is approximately equal to the width of the rail;

the body being pocket-shaped and capable of fitting over and substantially covering the rail, and comprising two elongated sides;

the body filter comprising a closed edge and an opposite, open edge, and two opposite, closed end edges, the two closed end edges of the body being shorter in length than the other two edges of the body;

the two elongated sides of the body comprising a soft, flexible, cushioning core along the interior;

the two elongated sides further comprising an outside and an inside, the outside comprising lock and loop fasteners; and a plurality of means for removable attachment of the elongated body to a bed rail; and (b) a bed rail; and wherein when the body is bent in two along its width, the lock and loop fasteners can be secured to each other; the bumper pad being capable of placement on the bed rail in an extended or folded position.

8. A device according to claim 7, wherein the rail is a telescoping rail.

9. A device according to claim 7, wherein the rail is a side rail on a hospital or geriatric bed.

10. A device according to claim 9, wherein there are two strips of lock and loop fastener on the outside side of the bumper pad.

* * * * *